United States Patent [19]

Lemke

[11] Patent Number: 4,764,262

[45] Date of Patent: Aug. 16, 1988

[54] HIGH QUALITY, BRIGHT NICKEL PLATING

[75] Inventor: Kenneth W. Lemke, Burlington, Canada

[73] Assignee: M&T Chemicals Inc., Woodbridge, N.J.

[21] Appl. No.: 87,011

[22] Filed: Aug. 19, 1987

Related U.S. Application Data

[63] Continuation of Ser. No. 687,499, Jan. 3, 1985, abandoned, which is a continuation-in-part of Ser. No. 74,953, Sep. 13, 1979, abandoned.

[51] Int. Cl.[4] ..... C25D 3/14

[52] U.S. Cl. ..... 204/49

[58] Field of Search ..... 204/49, 48, 45.1

[56] References Cited

U.S. PATENT DOCUMENTS

| | | | |
|---|---|---|---|
| 2,800,440 | 7/1957 | Brown | 204/49 |
| 2,852,449 | 9/1958 | Becking et al. | 204/49 |
| 2,882,208 | 4/1959 | Becking et al. | 204/49 |
| 3,075,898 | 1/1963 | Brown | 204/49 |
| 3,506,548 | 4/1970 | Duchene | 204/49 |
| 4,062,738 | 12/1977 | Rushmere | 204/49 |

*Primary Examiner*—John F. Niebling
*Assistant Examiner*—Nam X. Nguyen
*Attorney, Agent, or Firm*—S. A. Marcus; W. Katz

[57] ABSTRACT

An improved process and composition for the preparation of nickel or nickel alloy electrodeposits is provided. The process involves passing current from a anode to a cathode through an aqueous acidic electroplating solution containing zinc ions as impurities with the combination of at least one nickel compound, saccharin, and a sulfonated acetylenic compound or salt thereof, particularly propyne sulfonic acid.

The invention is particularly useful for electroplating nickel onto a zinc die cast substrate, where zinc ion impurity build-up in the bath occurs.

2 Claims, No Drawings

HIGH QUALITY, BRIGHT NICKEL PLATING

CROSS-REFERENCE TO RELATED PATENT APPLICATIONS

This application is a continuation of copending patent application No. 687,499, filed Jan. 3, 1985, now abandoned, which is a continuation-in-part of copending patent application No. 074,953, filed Sept. 13, 1979, now abandoned.

BACKGROUND OF THE INVENTION

1. Field of the Invention

This invention relates to improved processes and compositions for the electrodeposition of nickel and alloys thereof.

2. Brief Description of the Prior Art

It has been found that the presence of zinc impurities tends to produce plating defects during the electrodeposition of nickel electroplates using compositions containing primary and secondary brighteners. The problem is especially acute during plating when the secondary brightener is saccharin (o-benzoyl sulfimide). In this case inadequate basis metal coverage may occur in low current density areas; unsightly striated (ribbed) deposits may occur; and dark; thin non-metallic appearing deposits may be produced which not only detract from the final appearance of the article being plated, but may also interfere with the receptivity, appearance, luster, etc. of subsequent deposits such as chromium plate.

In order to overcome the deleterious effects of zinc in the presence of saccharin, the use of sulfonic acids or hydroxy-sulfonates has been used. While these compounds do reduce the problem, their use also reduces the overall brightness and leveling of the deposit. This results in having to use thicker nickel deposits or higher levels of the primary additives in order to obtain commercially acceptable deposits.

An alternative approach has been to replace saccharin with another Class I additive, i.e., sodium benzene sulfonamide or sodium toluene sulfonate. These Class I additives, while not as sensitive to zinc impurities as is saccharin, are inferior to saccharin with respect to stress reduction, luster building (in cooperation with Class II additives), and sulfur contribution (especially important in duplex plating).

SUMMARY OF THE INVENTION

An improved process and composition for the preparation of nickel or nickel alloy electrodeposits is provided. The process involves passing current from a anode to a cathode through an aqueous acidic electroplating solution containing zinc ions as impurities with the combination of at least one nickel compound, saccharin, and a sulfonated acetylenic compound or salt thereof, particularly propyne sulfonic acid.

The invention is particularly useful for electroplating nickel onto a zinc die cast substrate, where zinc ion impurity build-up in the bath occurs.

DESCRIPTION OF THE PREFERRED EMBODIMENTS

The concentrations of the additive compounds in are

| | Suitable | Preferred |
|---|---|---|
| (1) saccharin (brightener) | 0.2–10 g/l | 0.5–4.0 g/l |
| (2) zinc ions (impurities) | 20–500 ppm. | 20–250 ppm. |
| (3) propyne sulfonic acid, or salt thereof (improves quality of nickel deposit) | 0.01–1.0 g/l | 0.2 g/l |

If desired, the baths of this invention can also contain (a) other Class I brighteners in addition to saccharin; (b) Class II brighteners; and/or (c) anti-pitting or wetting agents.

The nickel compounds employed for electrodepositing nickel are typically added as the sulfate, chloride, sulfamate or fluoborate salts of nickel and are employed in concentrations sufficient to provide nickel in the electroplating solutions in concentrations ranging from about 10 to 250 grams per liter.

The nickel electroplating baths of this invention additionally may contain from about 30 to 60 grams per liter, preferably about 45 grams per liter, of boric acid or other buffering agents to control the pH (e.g., from about 3.0–5.0, preferably 4.0) and to prevent high current density burning.

In order to prevent "burning" of high current density areas, and provide for more even temperature control of the solution, solution agitation may be employed. Air agitation, mechanical stirring, pumping, cathode rod and other means of solution agitation are all satisfactory. Additionally, the solutions may be operated without agitation.

The operating temperature of the electroplating baths of this invention may range from about 40° C. to about 70° C., preferably from about 50° to 62° C.

The average cathode current density may range from about 0.5 to 12 amperes per square decimeter with 3 to 6 amperes per square decimeter providing an optimum range.

Typical aqueous nickel-containing electroplating solutions (which may be used in combination with effective amounts of cooperating additives) include the following wherein all concentrations are in grams per liter (g/l) unless otherwise indicated.

TABLE I

Aqueous Nickel-Containing Electroplating Solutions

| Component | Minimum | Maximum | Preferred |
|---|---|---|---|
| $NiSO_4.6H_2O$ | 75 g/l | 500 g/l | 300 g/l |
| $NiCl_2.6H_2O$ | 20 g/l | 135 g/l | 60 g/l |
| $H_3BO_3$ | 30 g/l | 60 g/l | 45 g/l |
| pH (electrometric) | 3.0 | 5/0 | 4.0 |

During bath operation, the pH may normally tend to rise and may be adjusted with acids such as hydrochloric acid, sulfuric acid, etc.

Anodes used in the above baths may be electrolytic or sulfur containing nickel bars, strips or small chunks in titanium baskets. All anodes are usually suitably covered with cloth or plastic bags of desired porosity to minimize introduction into the bath of metal particles, anode slime, or electrophoretically to give roughness in cathode deposits.

The substrates on which the nickel electrodeposits of this invention may be applied may be metal or metal alloys such as are commonly electrodeposited and used in the art of electroplating such as nickel, cobalt, nickel-cobalt, copper, tin, brass, etc. Other typical substrate basis metals from which articles to be plated or manufactured may include ferrous metals such as iron, steel, alloy steels, copper, tin and alloys thereof such as with lead, alloys of copper such as brass, bronze, etc., zinc, particularly in the form of zinc-base die castings alloy which may be over plated with other metals, such as copper, etc. Basis metal substrates may have a variety of surface finishes depending on the final appearance desired, which in turn depends on such factors as luster, brilliance, leveling, thickness, etc. of the nickel electroplate applied on such substrates.

It is in the electroplating of zinc base die castings that the application of this invention is particularly useful. During plating on such substrates, parts of the die castings may fall into the electroplating solution and produce high levels of zinc impurities. These zinc impurities, in the presence of saccharin, cause the unsightly electrodeposits mentioned previously.

The addition of propyne sulfonic acid or salts thereof, in an aqueous acidic nickel electroplating containing saccharin and such zinc impurities, produces a bright, well leveled deposit free from the previously mentioned defects.

The following examples are presented as an illustration to provide those skilled in the art of electroplating a better understanding of the various embodiments and aspects of this invention. These examples should not be construed as limiting the scope of the invention in any way.

| | Panel #1 | Panel #2 | Panel #3 | Panel #4 | Panel #5 |
|---|---|---|---|---|---|
| 1. $NiSO_4.6H_2O$ | 300 g/l | 300 g/l | 300 g/l | 300 g/l | 300 g/l |
| 2. $NiCl_2.6H_2O$ | 60 g/l | 60 g/l | 60 g/l | 60 g/l | 60 g/l |
| 3. $H_3BO_3$ | 45 g/l | 45 g/l | 45 g/l | 45 g/l | 45 g/l |
| 4. pH | 4.0 | 4.0 | 4.0 | 4.0 | 4.0 |
| 5. Temperature | 60° C. | 60° C. | 60° C. | 60° C. | 60° C. |
| 6. Saccharin | 1.8 g/l | 1.8 g/l | 1.8 g/l | 1.8 g/l | 1.8 g/l |
| 7. Zinc Ion | 100 ppm | 100 ppm | 50 ppm | Nil | Nil |
| 8. Sodium Salt of Propyne Sulfonic Acid | Nil | 0.1 g/l | Nil | Nil | 0.1 g/l |
| 9. Sodium Salt of 1-Butyne Sulfonic Acid | Nil | Nil | 0.1 g/l | Nil | Nil |
| 10. Propargyl Alcohol | 0.0075 g/l | 0.0075 g/l | 0.0075 g/l | 0.0075 g/l | 0.0075 g/l |
| 11. Diethoxylated 2-Butyne-1,4-Diol | 0.15 g/l | 0.015 g/l | 0.15 g/l | 0.015 g/l | 0.015 g/l |
| 12. 2-Butyne-1,4-Diol | 0.02 g/l | 0.02 g/l | 0.02 g/l | 0.02 g/l | 0.02 g/l |

The conditions for plating the panels from the above aqueous nickel electroplating compositions were as follows:

A zinc coated steel test panel was stripped in 50% hydrochloric acid, rinsed and then scribed with a horizontal single pass of 4/0 grit emery polishing paper and another scribe in a similar manner with #2 grit emery polishing paper. The cleaned panel was then plated in a 267 ml Hull Cell using the aforementioned compositions for 10 minutes at 2 amps. cell current, using cathode rod agitation.

Observations

Panel 1: Shows a bright, well leveled deposit, with low current density skip plate, severe darkness and striations.

Panel 2: Shows a bright, well leveled deposit, free from defects, over the entire current density range.

Panel 3: Shows a bright, well leveled deposit with only a very small amount of low current density darkness.

Panel 4: Shows a deposit with fair brightness and leveling with a slight amount of low current density hazing.

Panel 5: Shows a deposit with good brightness and leveling. A comparison of Panel 5 with Panel 2 is better, particularly in the high current density and low current density portions of the panel.

Although this invention has been illustrated by reference to specific embodiments, modifications thereof which are clearly within the scope of the invention will be apparent to those skilled in the art.

I claim:

1. A process for the preparation of a bright nickel electrodeposit onto a substrate substantially free of black streaking from a bright nickel electroplating bath containing about 20 to about 250 ppm of zinc ions as impurities comprising passing current from an anode to a cathode through an aqueous acidic nickel plating bath consisting essentially of about 0.2 g/l to about 10 g/l of saccharin and about 0.01 g/l to about 1.0 g/l of propyne sulfonic acid, or salt thereof, thereby to produce a bright, well leveled deposit of nickel on said substrate despite the presence of said zinc ion impurities in said bath.

2. An aqueous acid bright nickel electroplating solution for preparing bright nickel electrodeposits substantially free of black streaking in the presence therein of about 20 to about 250 ppm of zinc ions as impurities consisting essentially of about 0.2 g/l to about 10 g/l of saccharin and about 0.01 g/l to about 1.0 g/l of propyne sulfonic acid, or salt thereof.

* * * * *